US007932883B2

(12) United States Patent
Klompenhouwer et al.

(10) Patent No.: US 7,932,883 B2
(45) Date of Patent: Apr. 26, 2011

(54) SUB-PIXEL MAPPING

(75) Inventors: Michiel Adriaanszoon Klompenhouwer, Eindhoven (NL); Erno Hermanus Antonius Langendijk, Eindhoven (NL); Oleg Belik, Eindhoven (NL); Gerben Johan Hekstra, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 819 days.

(21) Appl. No.: 11/911,566

(22) PCT Filed: Apr. 13, 2006

(86) PCT No.: PCT/IB2006/051146

§ 371 (c)(1),
(2), (4) Date: Oct. 15, 2007

(87) PCT Pub. No.: WO2006/111895

PCT Pub. Date: Oct. 26, 2006

(65) Prior Publication Data

US 2008/0165204 A1 Jul. 10, 2008

(30) Foreign Application Priority Data

Apr. 21, 2005 (EP) ..... 05103235
Aug. 9, 2005 (EP) ..... 05107319

(51) Int. Cl.
*G09G 3/36* (2006.01)

(52) U.S. Cl. ..... 345/88; 345/89; 345/589; 345/600; 345/690; 345/694

(58) Field of Classification Search ..... 345/690–695, 345/77, 88–89, 589, 600
See application file for complete search history.

(56) References Cited

U.S. PATENT DOCUMENTS

| | | | | |
|---|---|---|---|---|
| 7,102,648 | B1 * | 9/2006 | Holub | 345/589 |
| 2004/0222999 | A1 * | 11/2004 | Choi et al. | 345/589 |
| 2005/0128224 | A1 * | 6/2005 | Baek et al. | 345/690 |

FOREIGN PATENT DOCUMENTS

| | | | |
|---|---|---|---|
| EP | 13888818 | A2 | 2/2004 |
| EP | 1457962 | A2 | 9/2004 |
| EP | 1475771 | A2 | 11/2004 |
| WO | WO2006106457 | A1 | 10/2006 |
| WO | WO2006111926 | A1 | 10/2006 |

OTHER PUBLICATIONS

Lee et al: "40.5L: Late-News Paper: TFT-LCD With RGBW Color System"; SID 03 Digest, ISSN/0003-0966X/03/3402, pp. 1212-1215.

* cited by examiner

*Primary Examiner* — Alexander Eisen
*Assistant Examiner* — Robin Mishler

(57) ABSTRACT

A method of mapping a four primary input signal to sets of four sub-pixels of a display device, the method including sub-sampling the input samples of the four primary input signal by assigning the first, second and third input signals of a particular input sample to the first, second and third sub-pixels, producing first, second and third primary colors of a particular set of four adjacent sub-pixels, respectively, and the fourth input signal of a further input sample to the fourth sub-pixel, producing a fourth color of said particular set of the four adjacent sub-pixels, wherein the particular input sample and the further input sample are associated with adjacent positions on the display device.

15 Claims, 7 Drawing Sheets

SUB-PIXEL MAPPING

Figure 1:
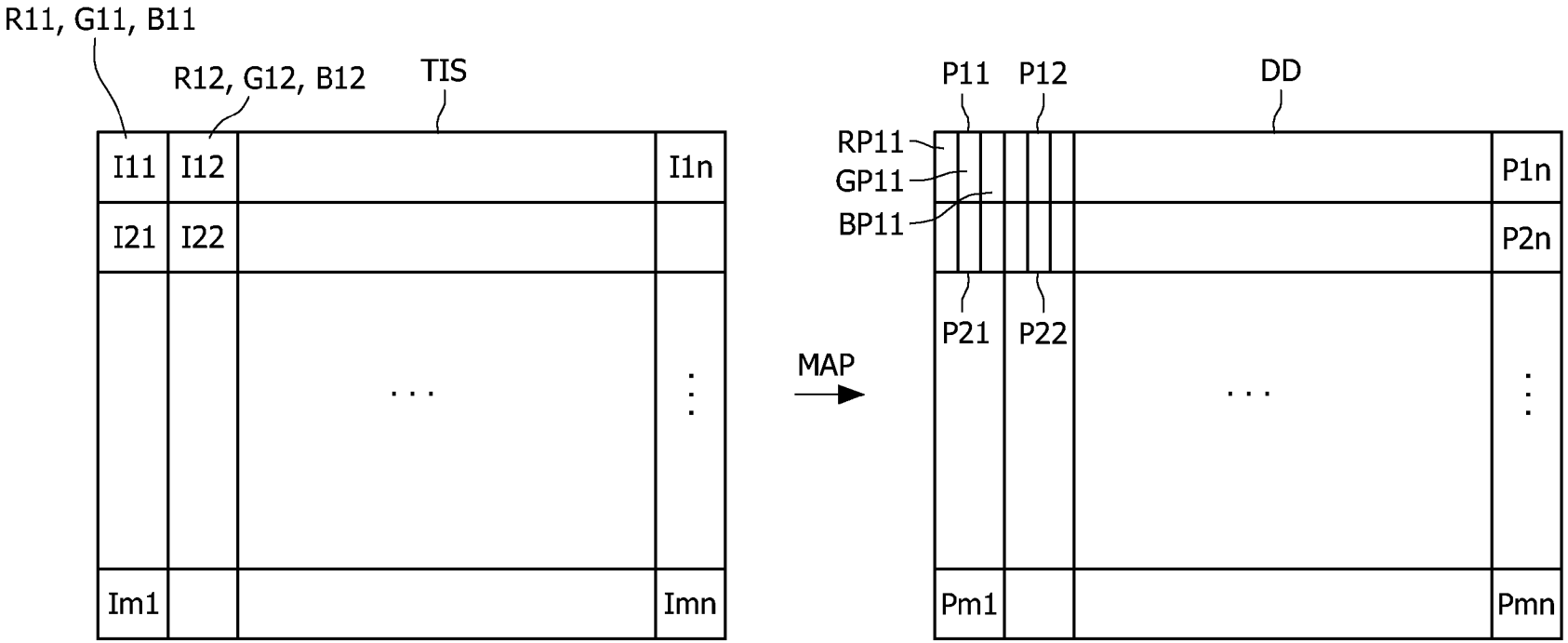

The invention relates to a method of mapping a four primary input signal to sets of four sub-pixels of a display device, a computer program product, a system for mapping a four primary input signal to sets of four sub-pixels of a display device, a circuit for driving a display device and comprising the system, a display apparatus comprising the circuit, a portable device comprising the circuit, a broadcast system, and a broadcast method.

Current displays have three differently colored sub-pixels which usually have the three primary colors R (red), G (green), and B (blue). These displays are driven by three input color signals which for a display with RGB sub-pixels preferably are RGB signals. The input color signals may be any other related triplet of signals, such as for example, YUV signals. However, these YUV signals have to be processed to obtain RGB drive signals for the RGB sub-pixels. Typically, these displays with three differently colored sub-pixels have a relatively small color gamut.

Displays with four sub-pixels which have different colors provide a wider color gamut if the fourth sub-pixel produces a color outside of the color gamut defined by the colors of the other three sub-pixels. Alternatively, the fourth sub-pixel may produce a color inside the color gamut of the other three sub-pixels. The fourth sub-pixel may produce white light. Displays which have four sub-pixels are also referred to as four primary displays. A display which has sub-pixels which emit R (red), G (green), B (blue), and W (white) light are generally referred to as RGBW displays.

More in general, displays which have $N \geqq 4$ differently colored sub-pixels are referred to as multi-primary displays. The N drive signals for the N primary colors of the sub-pixels are calculated from the three input color signals by solving a set of equations which define the relation between the N drive signals and the three input signals. Because only three equations are available while N unknown drive signals have to be determined, usually many solutions are possible. Multi-primary conversion algorithms convert the three input color signals into the N drive signals by selecting a solution out of the many possible solutions.

However, it appears to be a major challenge to map the three-primary input signal on the four primary sub-pixels. The addition of the fourth sub-pixel causes a decrease of the resolution of the display if all sub-pixels within one pixel receive drive values from the same input pixel. To restore the resolution, the conversion of the three-primary input signal to the four drive signals comprises a sub-sampling operation (by a factor two) by mapping two or more input samples on one group of four sub-pixels. The input signal, which usually comprises the RGB components, assumes a regular rectangular grid of display pixels. However, this regular rectangular grid of display pixels is lost due the sub-sampling and mapping. The sub-sampling causes color artifacts dependent on the values of the three components of the three-primary input signal.

It is an object of the invention to provide a method of mapping a four primary input signal to sets of four sub-pixels of a display which causes less loss of resolution.

A first aspect of the invention provides a method of mapping a four primary input signal to sets of four sub-pixels as claimed in claim 1. A second aspect of the invention provides a computer program product as claimed in claim 8. A third aspect of the invention provides a system for mapping a four primary input signal to sets of four sub-pixels of a display device as claimed in claim 10. A fourth aspect of the invention provides a circuit for driving a display device as claimed in claim 11. A fifth aspect provides a display apparatus as claimed in claim 12. A sixth aspect provides a portable device as claimed in claim 13. A seventh aspect provides a broadcast system as claimed in claim 14. An eighth aspect provides a method of broadcasting as claimed in claim 15. Advantageous embodiments are defined in the dependent claims.

The present invention is directed to mapping samples of the four-primary input signal on the sets of four sub-pixels of the display device. It is assumed that the conversion from the three input color signal to the four-primary input signal has already been performed. Alternatively, the four-primary input signal may be generated by an auxiliary device such as a camera, a server, or a video processing device. The four-primary input signal comprises a sequence of input samples which each comprise four sub-samples which have a value for a first input signal, a value for a second input signal, a value for a third input signal, and a value for a fourth input signal, respectively. These values of the sub-samples are referred to as components of the samples, or just as components.

The sets of four sub-pixels comprise a first sub-pixel which supplies light with a first color, a second sub-pixel which supplies light with a second color, a third sub-pixel which supplies light which a third color, and a fourth sub-pixel which supplies light with a fourth color. The first, second, third and fourth colors are all different, and the fourth color lies within the color gamut of the first, second, and third color.

The method comprises a sub-sampling process which sub-samples the samples of the four-primary input signal. The first component, the second component, and the third component of a first input sample are assigned to the first, second and third sub-pixel, respectively, of a particular group of adjacent sub-pixels. The fourth component of a second input sample is assigned to the fourth sub-pixel of this same particular group of adjacent sub-pixels. The first input sample and the second input sample are associated with adjacent positions on the display device. Thus, the fourth component of the first input sample, and the first, second, third components of the second input sample are not allocated to sub-pixels of the particular group of adjacent sub-pixels. Preferably, these components of the first and second input sample are not generated or transmitted at all, which provides a more efficient multi-primary conversion. Further, this has the advantage that no filtering is required before the mapping. In fact, the mapping/sub-sampling is so simple, that it probably may be part of the multi-primary conversion (i.e. the multi-primary conversion only outputs the sub-pixel values as needed on the display).

This sub-sampling process is performed in such a manner that the loss of resolution in the luminance is perceptually less noticeable because both the group of first, second, and third input component of the first input sample, and the fourth input component of the second sample define a luminance component with respect to the fourth color. Further, the conversion and mapping prevents serious color artifacts in that an uncolored (grayscale) image remains uncolored.

Thus, this special mapping algorithm has the main advantage that both the group of first, second, and third sub-pixel on the one hand, and the fourth sub-pixel on the other hand represent luminance information with respect to the color of the fourth sub-pixel.

Further, no color errors will occur in the color related to the fourth color component. For example, when displaying black and white information and using a first sub-pixel which supplies red light, a second sub-pixel which supplies green light, a third sub-pixel which supplies blue light, and a fourth sub-pixel which supplies white light, no color errors occur because the group of first, second, and third sub-pixels is able to supply white light. If the fourth sub-pixel has another color, again it is possible to produce the same color with the group of first, second, and third sub-pixels because this another color is within the gamut of the colors which can be produced by the first, second, and third sub-pixels.

In contrast, if the mapping does not contain an assignment of the components of the same input sample to the first, second, and third sub-pixel, a color error results when displaying black and white information if the fourth sub-pixel supplies white light.

In an embodiment as claimed in claim 3, the display device is illuminated by a backlight unit. Thus, the light supplied by the sub-pixels is obtained by modulating the impinging light originating from the backlight unit. To obtain red, green, and blue light, a red, green, and blue filter, is associated with the first, second, and third sub-pixel, respectively. The light supplied by the backlight unit passes the fourth sub-pixel unfiltered. Of course, all the sub-pixels, thus also the fourth are able to modulate the intensity of the impinging light in response to a drive voltage determined by the associated component. Preferably, the light supplied by the backlight unit is white. But, alternatively, the light of the backlight unit may have another color, and the colors of the first to third sub-pixels may differ from red, green, and blue. This is especially interesting in displays that apply a different (more bluish) white-point (which still is called 'white'). It is also interesting in a color sequential display, where the backlight is white on average, but red/green/blue in alternate frames, while the sub-pixels on the display are still RGBW.

In an embodiment as claimed in claim 5, in the four-primary input signal, the further input sample is located relative to the particular input sample to correspond to a position of the fourth sub-pixel relative to the sub-group of the first, second and third sub-pixels in the set of sub-pixels, respectively. This provides an optimal timing of the input samples with respect to the sub-pixel geometry. The fourth sub-pixel may be present in a same horizontal line (row) or vertical line (column) on the display screen. But other geometries are possible, for example, the fourth sub-pixel may be present in the adjacent line at the center position of the first, second, and third sub-pixel.

In an embodiment as claimed in claim 6, the second input sample immediately succeeds or precedes the first input sample in a first line of a video input image. The first, second, third components of the first input sample are used to drive the first, second, and third sub-pixels of a first set of sub-pixels. The fourth component of the second input sample is used to drive the fourth sub-pixel of the first set of sub-pixels.

Further, a third and a fourth input sample are sub-sampled to a second set of sub-pixels. The second set comprises a fifth sub-pixel for supplying light with the first color, a sixth sub-pixel for supplying light with the second color, a seventh sub-pixel for supplying light with the third color, and an eighth sub-pixel for supplying light with the fourth color. The sub-sampling assigns the first, second, and third component of the fourth input sample to the fifth, sixth and seventh sub-pixel, respectively, and the fourth component of the third input sample to the eighth sub-pixel. The fourth input sample immediately succeeds or precedes the third input sample in a second line of the video input image. The second line immediately succeeds or precedes the first line. It has to be noted that the lines of the video input image may extend in the horizontal direction or in the vertical direction. In the horizontal direction, the input samples directly follow each other in time. In the vertical direction, the input samples are delayed one line period with respect to each other.

In an embodiment as claimed in claim 7, the mapping in accordance with the invention is preceded by a conversion of the three primary color input signal into the four primary input signal. This conversion is made under an equal luminance constraint for, on the one hand the luminance of the combination of the first sub-pixel, the second sub-pixel, and the third sub-pixel, and on the other hand the luminance of the fourth sub-pixel. This has the advantage that the luminance difference between the fourth sub-pixel and the group of first, second, and third sub-pixels is minimal.

These and other aspects of the invention are apparent from and will be elucidated with reference to the embodiments described hereinafter.

Figure 2:
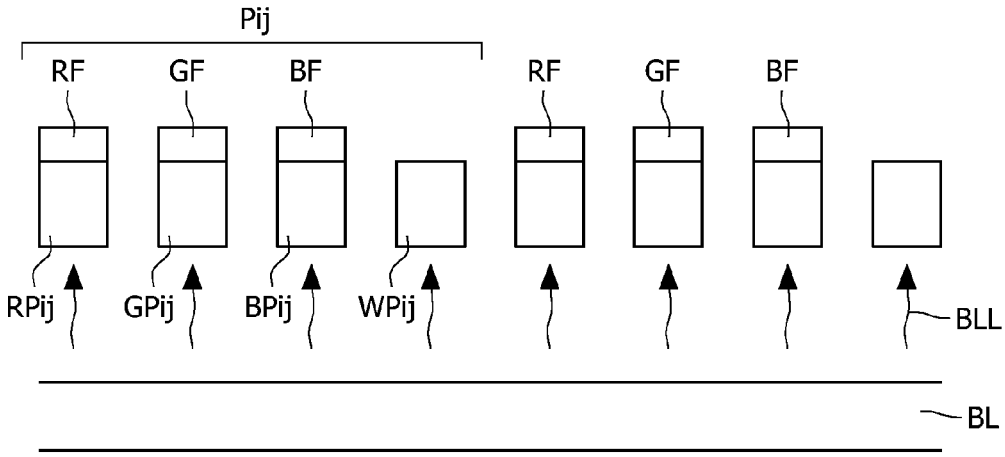
Figure 3:
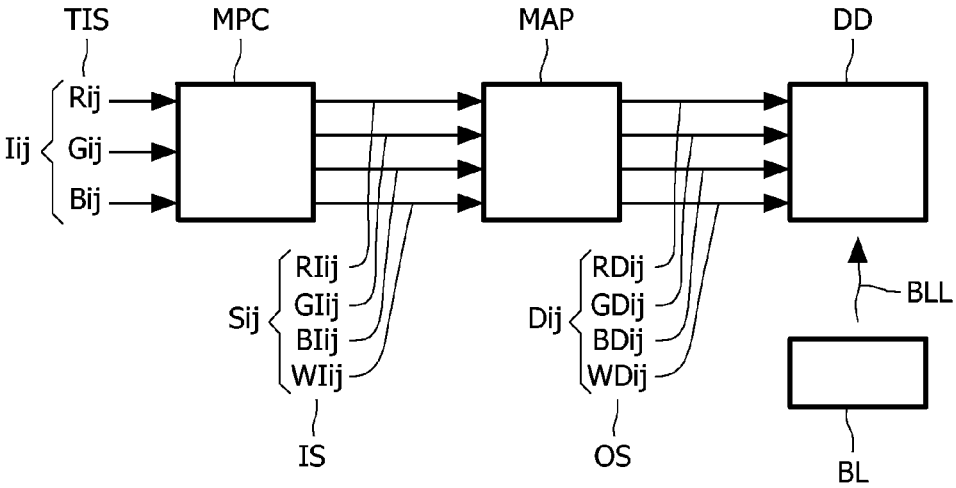
Figure 4:
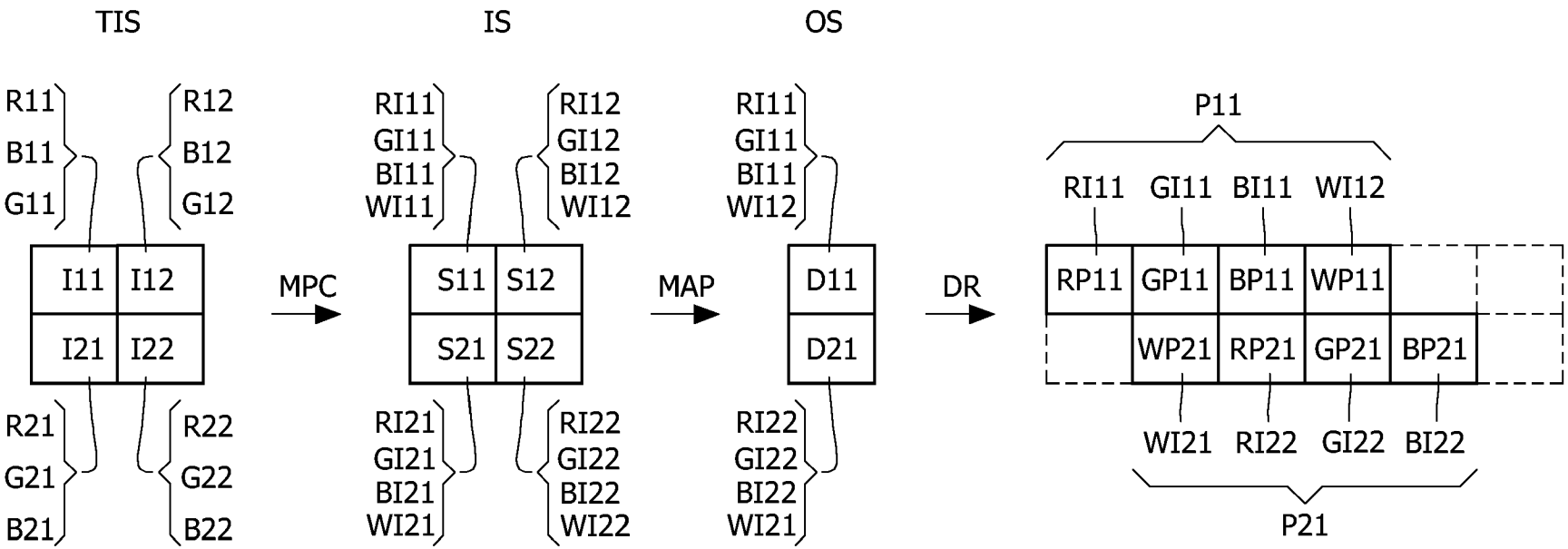
Figure 5:
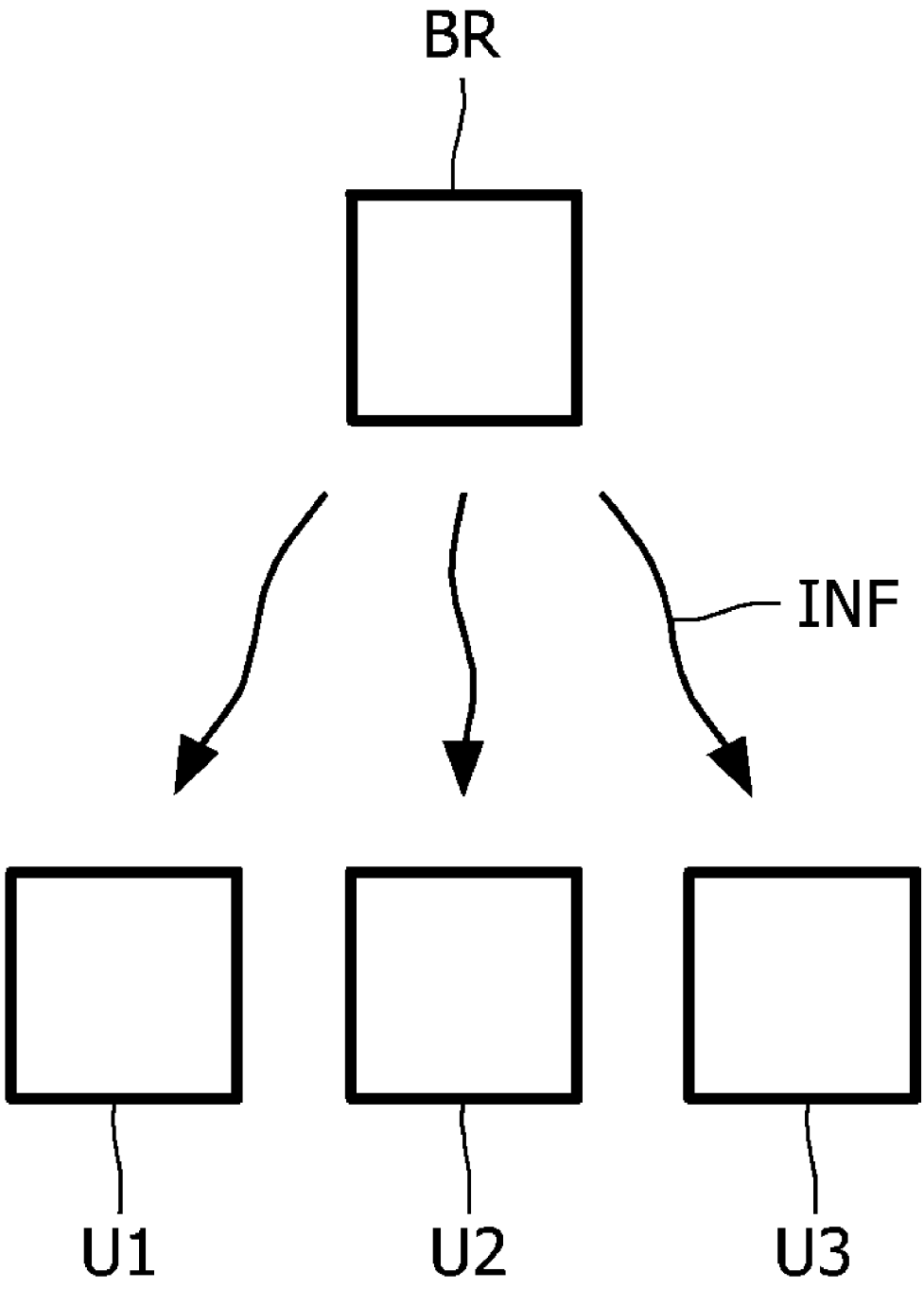
Figure 6:
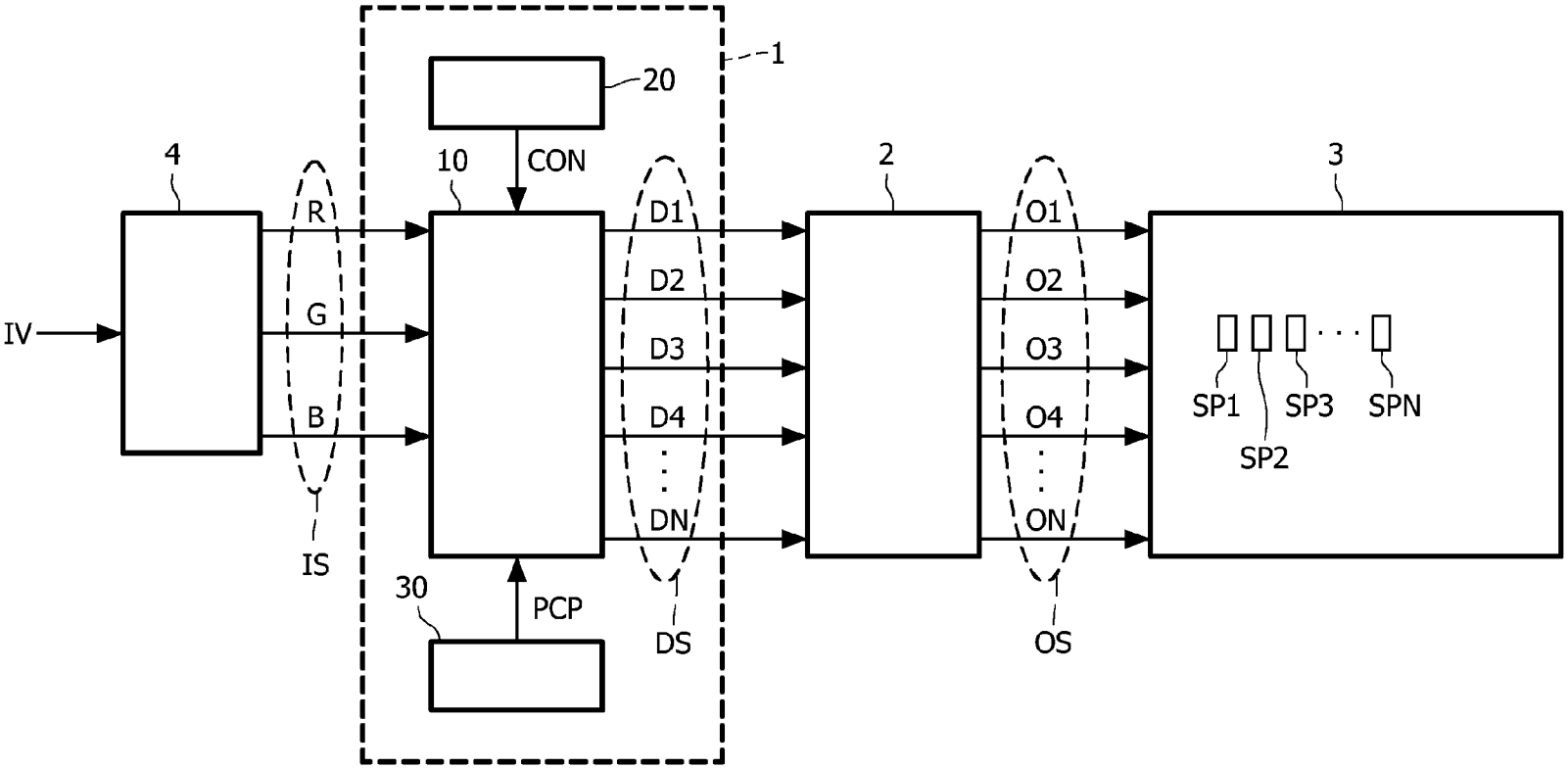
Figure 7:
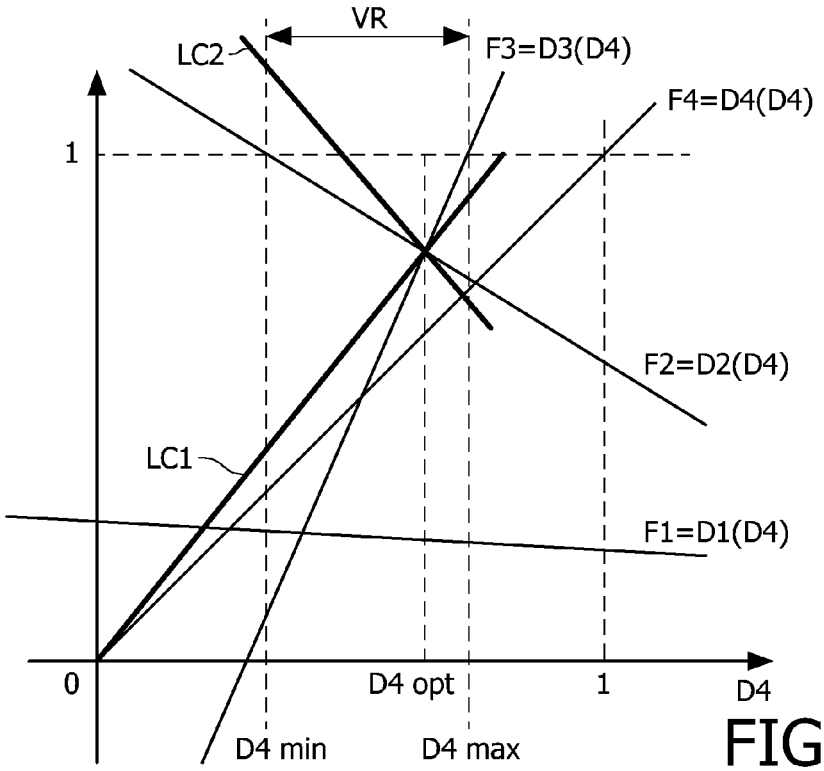
Figure 8:
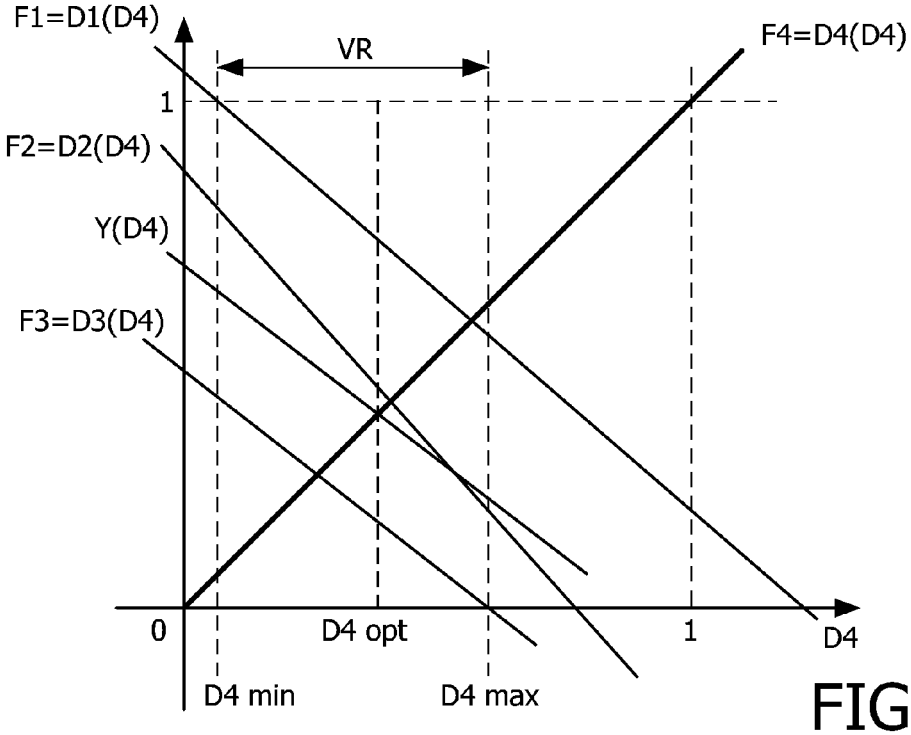
Figure 9:
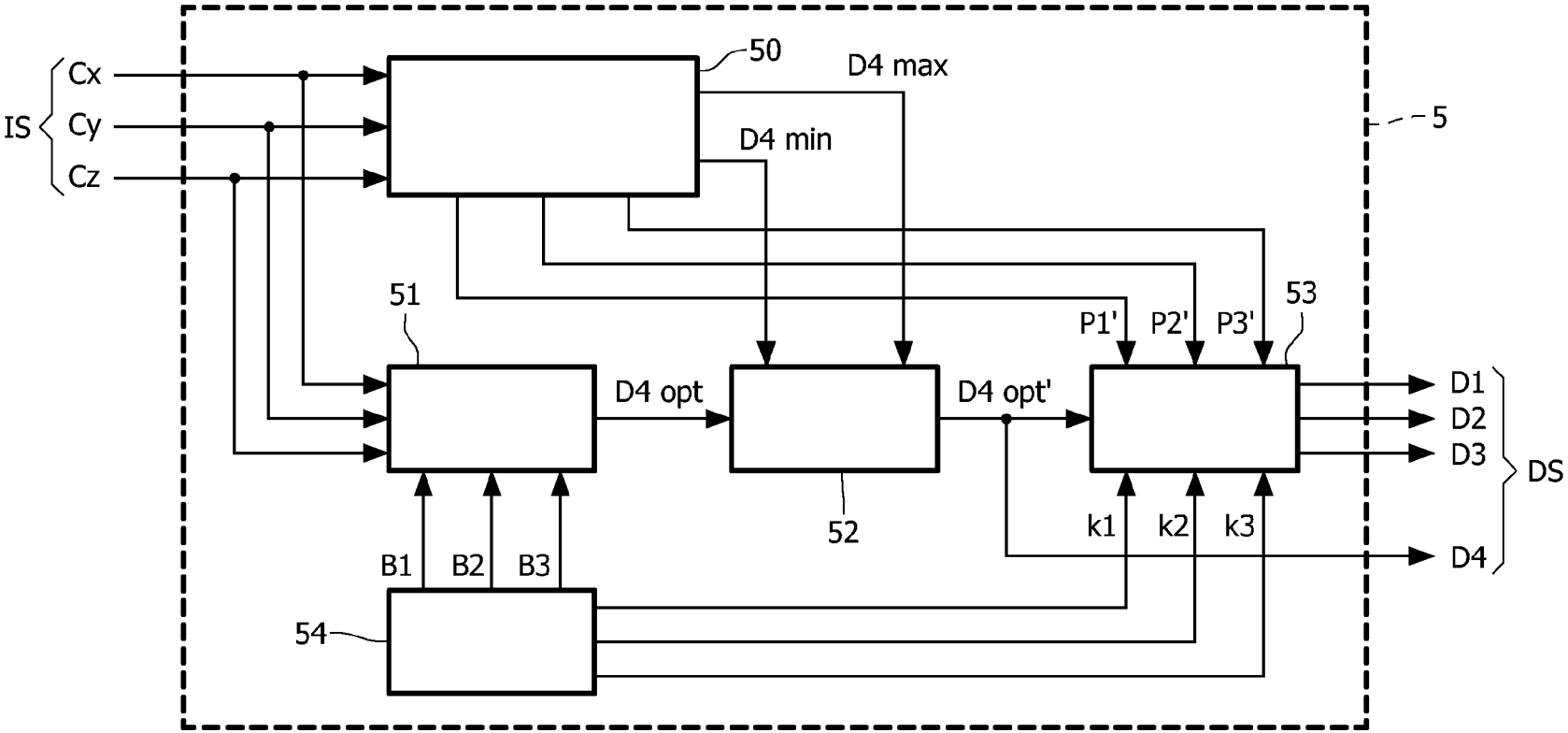

In the drawings:

FIG. 1 shows a prior art mapping of a three-primary input signal on a display with sets of three primary sub-pixels, FIG. 2 shows schematically a portion of an LCD display which has sets of four sub-pixels and which is illuminated by a backlight unit, FIG. 3 shows a block diagram of a display apparatus which comprises the system for mapping a four-primary input signal to the sets of four sub-pixels, FIG. 4 shows a mapping of the four-primary input signal on a display with sets of four primary sub-pixels in accordance with an embodiment of the invention, FIG. 5 shows a broadcast system which provides information which comprises signals for driving the four primary sub-pixels, FIG. 6 shows schematically a block diagram of a display apparatus which comprises a system for converting a three-primary input color signal into an N-primary color drive signal, FIG. 7 shows a graph for elucidating an embodiment of the additional equation, FIG. 8 shows a graph for elucidating another embodiment of the additional equation, and FIG. 9 shows a block diagram of an embodiment of an implementation of the conversion in accordance with the invention.

It should be noted that items which have the same reference numbers in different Figures, have the same structural features and the same functions, or are the same signals. Where the function and/or structure of such an item have been explained with respect to a particular Figure, there is no necessity for repeated explanation thereof in the detailed description of another Figure.

In a reference which starts with a particular number of capital letters followed by the letters i and/or j, the i and j are indices. These indices i and j indicate the item indicated by the capital letter(s) in general, or may refer to any one of the items indicated by the reference. If a particular one of the items is addressed, the indices are replaced by a number. For example, if the capital letter P is used to indicate pixels of a matrix display, Pij refers to either all the pixels of the matrix display or to one of these pixels. In contrast Pmn refers to the pixel in the $m^{th}$ row and the $n^{th}$ column. Indices used in the claims are merely referring to what is shown in the Figures and may not be construed to limit scope of the claims.

FIG. 1 shows a prior art mapping of a three-primary input signal on a display with sets of three primary sub-pixels.

The display device DD is shown at the right hand side as a matrix display in which the pixels Pij are arranged in m rows and n columns. The first row comprises the pixels P11, P12, . . . , P1*n*, the second row comprises the pixels P21, P22, . . . , P2*n*, the last row comprises the pixels Pm1 to Pmn. Each one of the pixels Pij comprises three sub-pixels RPij, GPij, and BPij. In FIG. 1, only the sub-pixels RP11, GP11, BP11 are indicated by a reference.

The three primary input signal TIS is shown on the left hand side. The three primary input signal TIS, which is further also referred to as the input signal, comprises a sequence of input samples Iij. Each one of the input samples comprises three values: a first value which defines the red component Rij, a second value which defines the green component Gij, and a third value which defines the blue component Bij. In FIG. 1, for one frame of the input image, only the samples I11, I12 and I1*n* of the first line of the input image, the samples I21 and I22 of the second line of the input image, and the samples Sm1 and Smn of the last line of input image are shown. In the first line only the components R11, G11, B11, and R12, G12, B12 are indicated. Although the samples Iij of the three-primary drive signal are usually supplied time sequentially and the mapping of the samples Iij on the correct pixels Pij of the display is obtained by synchronizing the writing of the samples Iij to the pixels Pij with the occurrence of the samples Iij, in the left hand matrix of FIG. 1 the samples are thought to be organized to have already the correct relation with the position on the display device DD.

The prior art mapping is quite straightforward, of the input sample Iij which is intended to be displayed at the corresponding pixel Pij, the first component Rij is used to drive the first sub-pixel RPij, the second component Gij is driving the second sub-pixel GPij, and the third component Bij is driving the third sub-pixel BPij. Of course, the color associated with the components and the sub-pixels should match. Usually, the first value Rij is the red component of the input sample Iij and the first sub-pixel RPij supplies red light, the second value Gij is the green component of the input sample Iij and the second sub-pixel GPij supplies green light, the third value Bij is the blue component of the input sample Iij and the third sub-pixel GPij supplies blue light. Of course, the order of the sub-pixels GPij may differ.

Thus, the mapping in the prior art system is a simple one to one mapping. However, if the original three-primary input signal TIS has to be displayed on a display which has sets of four sub-pixels, this mapping becomes much more complex. The original three-primary input signal TIS first has to be transformed into a four-primary input signal IS of which the four components match the four colors of the four sub-pixels. If now each one of the four components of the input samples Sij of the four primary input signal IS are one to one mapped to the four sub-pixels, either the resolution of the display decreases (if the dimensions of the sub-pixels of the four and three sub-pixel displays are identical) or the light output per sub-pixel decreases (if the resolution is kept constant). These problems can be solved by sub-sampling the four primary drive signal with a factor two. This means that two input samples are mapped on the same set of four sub-pixels.

The present invention is directed to a particular mapping of the input samples on the four sub-pixels. The particular mapping will be elucidated with respect to FIGS. 3 and 4. First, in FIG. 2 a particular embodiment of the display device DD is elucidated.

FIG. 2 shows schematically a portion of an LCD display which has sets of four sub-pixels and which is illuminated by a backlight unit. The LCD display has sets of four sub-pixels RPij, GPij, BPij, WPij of LCD material of which the transmission can be controlled in a well known manner by applying a drive voltage to the LCD material. The supporting substrates and the polarizers of the LCD display are not shown. The four sub-pixels RPij, GPij, BPij, WPij are illuminated by light BLL generated by the backlight unit BL. Only two sets Pij of four adjacent sub-pixels RPij, GPij, BPij, WPij are shown. A first color filter RF is associated with the sub-pixels RPij, a second color filter GF is associated with the sub-pixels GPij, and a third color filter BF is associated with the sub-pixels BPij. The color filters RF, GF, BF filter different colors, such that the associated LCD sub-pixels provide different spectral portions of the light BLL. These different spectral portions may partially overlap. No color filter is associated with the sub-pixel WPij, thus the color of the light contributed by the sub-pixel WPij is identical to the color of the light BLL. The color filters RF, GF, BF are selected such that the mixed light of the sub-pixels RPij, GPij, and BPij can have the same (visible) color as the light BLL.

Preferably, the color filters RF, GF, BF are red, green, and blue filters, respectively, and the light BLL is white light.

FIG. 3 shows a block diagram of a display apparatus which comprises the system for mapping a four-primary drive signal to the sets of four sub-pixels. This system starts from a three-primary input signal TIS which has samples Iij which each comprise a Rij (usually, the red) component, Gij (usually, the green) component, and Bij (usually, the blue) component. A multi-primary converter MPC converts the samples Iij of the three-primary input signal TIS into samples Sij of a four-primary input signal IS. The samples Sij of the four-primary input signal IS comprise RIij, GIij, BIij, WIij, components. The multi-primary conversion MPC as such is well known.

The sub-sampler or mapper MAP in accordance with the invention maps the samples RIij, GIij, BIij, WIij to the four-primary output signal OS which comprises per sample Dij the four components RDij, GDij, BDij and WDij which drive the sub-pixels RPij, GPij, BPij, and WPij, respectively. The display DD and the backlight unit BL which emits the backlight BLL are shown schematically only. Preferably, the display DD is a matrix display. The display DD may be an LCD as shown in FIG. 2, or another display which is able to modulate the light BLL from the backlight unit BL. The modulation may be obtained by varying the transmission or the reflectivity of the sub-pixels RPij, GPij, BPij, and WPij. The backlight unit BL may modulate the light BLL in intensity and color. In displays in which the sub-pixels emit light, such as LED displays, the backlight unit BL may be omitted.

The display apparatus may be a television, a computer monitor, or any other device which has a display, such as for example, a handheld apparatus for mobile communication or personal use (for example, a Personal Digital Assistant, or an electronic book).

FIG. 4 shows a mapping of the four-primary input signal on a display with sets of four primary sub-pixels in accordance with an embodiment of the invention. FIG. 4 shows the processes of multi-primary conversion MPC and mapping MAP of a particular block of four adjacent input samples I11, I12, I21, I22 of the three primary input signal TIS to two adjacent sets (shown at the right hand of FIG. 4, which, for clarity, shows only two sets of four adjacent sub-pixels of the display DD) of four adjacent sub-pixels. The first adjacent set P11 of four adjacent sub-pixels comprises the sub-pixels indicated by RP11, GP11, BP11, and WP11, which in this example are the first four sub-pixels on the first row of pixels on the display screen of the display device DD. The second adjacent set P21 of four adjacent sub-pixels comprises the sub-pixels indicated by RP21, GP21, BP21, and WP21. The same processes are applied on the remaining blocks of four adjacent samples of the three primary input signal TIS to the remaining sets Pij of the four adjacent sub-pixels. It has to be noted that the mapping in accordance with the invention can be advantageously implemented on other geometrical distributions of the sub-pixels of the sets. Before elucidating the multi-primary conversion MPC and mapping processes MAP first the different signals in FIG. 4 are discussed.

The sample I11 comprises the components R11, G11, B11, the sample I12 comprises the components R12, G12, B12, the sample I21 comprises the components R21, G21, B21, and the sample I22 comprises the components R22, G22, B22. In fact the three-primary input signal TIS is a sequence of samples which each comprise three components. The components Rij, Gij, Bij of each sample Iij define the contribution of the three primary colors associated with the three components Rij, Gij, Bij to the intensity and color of the sample Iij. The sample Iij is thought to be displayed on a display such that: the first component Rij is driving a first sub-pixel which emits light with a color which matches the primary color associated with the first component, the second component Gij is driving a second sub-pixels which emits light with a color which matches the primary color associated with the second component, and the third component Bij is driving a third sub-pixel which emits light with a color which matches the primary color associated with the third primary color. Thus, groups of three sub-pixels are able to display the color gamut defined by the three different primary colors of the three sub-pixels. Preferably this color gamut optimally matches the color gamut defined by the three primary colors of the samples Iij. Usually, the three primary colors of the components Rij, Gij, Bij of the samples Iij and of the sub-pixels is RGB (red, green, and blue).

The multi-primary conversion MPC converts the input samples I11, I12, I21, I22 into further samples S11, S12, S21, S22 of a four-primary input signal IS. The sample S11 comprises the components RI11, GI11, BI11, WI11, the sample S12 comprises the components RI12, GI12, BI12, WI12, the sample S21 comprises the components RI21, GI21, BI21, WI21, and the sample S22 comprises the components RI22, GI22, BI22, WI22. The components RIij are thought to be displayed on sub-pixels which have a first color, the components GIij are thought to be displayed on sub-pixels which have a second color, the components BIij are thought to be displayed on sub-pixels which have a third color, and the components WIij are thought to be displayed on sub-pixels which have a fourth color. Thus, now the original three primary input signal TIS has to be displayed on sets Pij of four sub-pixels RPij, GPij, BPij, WPij. The multi-primary conversion MPC has to convert the values of the three components per sample Iij into values of the four components per sample Sij, taking the primary colors of the three components and the colors of the four sub-pixels RPij, GPij, BPij, WPij into account.

The multi-primary conversion MPC as such is well known. The invention is directed to the mapping algorithm MAP in a special case wherein the fourth color of the sub-pixels WPij is within the color gamut defined by the first color, the second color, and the third color. Now, the mapper MAP has many possibilities to map the four-primary input signal IS into a four-primary output signal OS. The four-primary output signal OS comprises samples Dij, which each comprise the components RDij, GDij, BDij, WDij which drive the four adjacent sub-pixels RPij, GPij, BPij, WPij, respectively, of a same set Pij.

It is possible to map the components RIij, GIij, BIij, WIij of the four-primary input signal IS one to one to the components RDij, GDij, BDij, WDij of the four-primary output signal OS. Thus, every four-primary input sample Sij is displayed on a set of four sub-pixels Pij. However, the addition of the fourth sub-pixel causes a decrease of the resolution of the display DD if the luminance should not be sacrificed. Or the luminance per sub-pixel decreases if the resolution is kept constant.

To restore the resolution, the mapping MAP of the four-primary input signal IS to the four-primary output signal OS comprises a sub-sampling operation by a factor two by mapping two input samples Sij on one set Pij of four adjacent sub-pixels RPij, GPij, BPij, WPij. The original three-primary input signal TIS assumes a regular rectangular grid of display pixels and their sub-pixels. The mapping MAP further decreases color artifacts in the color of the fourth sub-pixel WPij.

The special mapping MAP in accordance with the invention alleviates the color artifacts. The basic idea is that two samples S11 and S12 (or S21 and S22) are mapped to one set P11 (or P21) of four sub-pixels RPij, GPij, BPij, WPij in the following manner. A particular sample Dij of the four-primary output signal OS has a first component RDij which is the first component RIij of the first sample S11, a second component GDij which is the second component GIij of the first sample S11, a third component BDij which is the third component BIij of the first sample S11, and a fourth component WDij which is the fourth component WIij of the second sample S12. Thus, the two consecutive samples Sij of the four-primary input signal IS are converted into one sample Dij of the four-primary output signal OS. The three primaries which are able to provide together the same luminance as the fourth primary originate from one of the two adjacent samples Sij, the fourth primary originates from the other one of the two samples Sij. The same holds for all other two adjacent samples Sij. This has the advantage that no luminance errors occur because the other three sub-pixels RPij, GPij, BPij of the same set Pij are able to supply the same luminance. Further, this approach has the advantage that the luminance can be divided over the fourth sub-pixel WPij on the one hand and the set of first, second, and third sub-pixels RPij, GPij, BPij on the other hand without introducing color errors.

In a preferred embodiment, the mapping MAP in accordance with the invention is combined with a multi-primary conversion MPC which converts the three-primary input signal TIS into a four-primary input signal IS under an equal luminance constraint per sample such that, if possible dependent on the input color, the luminance of the three components RIij, GIij, BIij, which are able to produce the same color as the fourth component WIij, is the same as the luminance of the fourth component WIij. Such a multi-primary conversion under an equal luminance constraint is described in the patent application Ser. No. 11/911,584 which has been filed on the same day as the present patent application, and is elucidated with respect to FIGS. 6 to 9.

The mapping shown in FIG. 4 is a special example showing an advantageous mapping to adjacent sets Sij of sub-pixels RPij, GPij, BPij, WPij in adjacent rows wherein the sub-pixels WPij supplying the fourth light are substantially positioned in the same row as the center sub-pixel of the group of the three sub-pixels RPij, GPij, BPij which are able to provide together the same color as the fourth sub-pixel WPij. The first component RI11, the second component GI11, the third component BD11 of the first sample S11 are mapped on the first component RD11, the second component GD11, the third component BD11, respectively, of the sample D11 and thus on the first sub-pixel RP11, the second sub-pixel GP11, the third sub-pixel BP11, respectively, of the first set P11 of four sub-pixels. The fourth component WI12 of the sample S12 is mapped to the fourth component WD11 of the sample D11 and thus to the fourth sub-pixel WP11 of the first set P1. The fourth component WI21 of the sample S21 is mapped to the fourth component WD21 of the sample D21, and thus to the fourth sub-pixel WP21 of the second set P21 of adjacent sub-pixels. The first component RI22, the second component GI22, and the third component BI22 of the sample S22 are mapped to the first component RD21, the second component GD21, and the third component BD21, respectively, of the sample D21, and thus to the first sub-pixel RP21, the second sub-pixel GP21, and the third sub-pixel BP21 of the second set P21.

FIG. 5 shows a broadcast system which provides information which comprises signals for driving the four primary sub-pixels RPij, GPij, BPij, WPij. The broadcast system comprises a distribution station BR which provides information INF to displays of the users U1, U2, U3. The information INF may be identical for the users or may be tailored to the personal desires of the users. The information INF comprises the for each set Pij of four sub-pixels RPij, GPij, BPij, WPij of the display DD of a user, the first, second, third, RI11, GI11, BI11 input signal of the particular input sample SI11, and the fourth input signal WI12 of the adjacent input sample S12.

FIG. 6 shows schematically a block diagram of a display apparatus which comprises a system for converting a three-primary input color signal into an N-primary color drive signal. The system 1 for converting the three-primary input color signal IS into an N-primary color drive signal DS comprises a multi-primary conversion unit 10, a constraint unit 20, and a parameter unit 30. These units may be hardware or software modules. The constraint unit 20 provides a constraint CON to the conversion unit 10. The parameter unit 30 provides primary color parameters PCP to the conversion unit 10.

The conversion unit 10 receives the three-primary input signal IS and supplies an N-primary drive signal DS. The three-primary input signal IS comprises a sequence of input samples which each comprise three input components R, G, B. The input components R, G, B of a particular input sample define the color and intensity of this input sample. The input samples may be the samples of an image which, for example, is produced by a camera or a computer. The N-primary drive signal DS comprises a set of drive samples which each comprise N drive components D1 to DN. The drive components D1 to DN of a particular output sample define the color and intensity of the drive sample. Usually the drive samples are displayed on pixels of a display device 3 via a drive circuit 2 which processes the drive samples such that output samples are obtained suitable to drive the display 3. The drive components D1 to DN define the drive values O1 to ON for the sub-pixels SP1 to SPN of the pixels. In FIG. 1 only one set of the sub-pixels SP1 to SPN is shown. For example, in a RGBW display device the pixels have four sub-pixels SP1 to SP4 which supply red (R), green (G), blue (B), and white (W) light. A particular drive sample has four drive components D1 to D4 which give rise to four drive values O1 to O4 for the four sub-pixels SP1 to SP4 of a particular pixel.

The display apparatus further comprises a signal processor 4 which receives the input signal IV which represents the image to be displayed, to supply the three-primary input signal IS. The signal processor 4 may be a camera, the input signal IV is than not present. The display apparatus may be part of a portable device such as, for example, a mobile phone or a personal digital assistant (PDA).

FIG. 7 shows a graph for elucidating an embodiment of the additional equation. FIG. 7 shows an example wherein N=4. The graph shows the three drive components D1 to D3 as a function of the fourth drive component D4. The fourth drive component D4 is depicted along the horizontal axis, and the three drive components D1 to D3 together with the fourth drive component D4 along the vertical axis. Usually, the drive components D1 to D4 are used to drive sets of sub-pixels of the display 3, and in the now following are also referred to as drive signals. The drive components D1 to D4 of a same drive sample may drive the sub-pixels of a same pixel. Alternatively, the drive components D1 to D4 of adjacent samples may be sub-sampled to sub-pixels of the same pixel. Now, not all drive components D1 to D4 are actually assigned to a sub-pixel.

The three drive signals D1 to D3 are defined as functions of the fourth drive signal D4: F1=D1(D4), F2=D2(D4), and F3=D3(D4). The fourth drive signal D4 is a straight line through the origin and has a first derivative which is one. The valid ranges of the four drive signals D1 to D4 are normalized to the interval 0 to 1. The common range VR of the fourth drive signal D4 in which all the four drive signals D1 to D4 have values within their valid ranges extends from the value D4min to D4max, and includes these border values.

In this example, a linear light domain is selected wherein the functions defining the three drive signals D1 to D3 as a function of the fourth drive signal D4 are defined by the linear functions:

$$\begin{bmatrix} D1 \\ D2 \\ D3 \end{bmatrix} = \begin{bmatrix} P1' \\ P2' \\ P3' \end{bmatrix} + \begin{bmatrix} k1 \\ k2 \\ k3 \end{bmatrix} \times D4$$

wherein D1 to D3 are the three drive signals, (P1', P2', P3') are defined by the input signal which usually is a RGB signal, and the coefficients ki define a dependence between the color points of the 3 primaries associated with the 3 drive values D1 to D3, and the primary associated with the fourth drive signal D4. Usually these coefficients are fixed and can be stored in a memory.

To further elucidate the relation between the elements of these functions it is now shown how the above functions relate to the standard three to four primary conversion. In a standard three to four primary conversion, the drive signal DS, which comprises the drive signals D1 to D4, is transformed to the linear color space XYZ by the following matrix operation.

$$\begin{bmatrix} Cx \\ Cy \\ Cz \end{bmatrix} = \begin{bmatrix} t11 & t12 & t13 & t14 \\ t21 & t22 & t23 & t24 \\ t31 & t32 & t33 & t34 \end{bmatrix} \times \begin{bmatrix} D1 \\ D2 \\ D3 \\ D4 \end{bmatrix} = [T] \times \begin{bmatrix} D1 \\ D2 \\ D3 \\ D4 \end{bmatrix} \quad \text{Equation 1}$$

The matrix with the coefficients tij defines the color coordinates of the four primaries of the four sub-pixels. The drive signals D1 to D4 are unknowns which have to be determined by the multi-primary conversion. This equation 1 cannot be solved immediately because there are multiple possible solutions as a result of introducing the fourth primary. A particular selection out of these possibilities for the drive values of the drive signals D1 to D4 is found by applying a constraint which is a fourth linear equation added to the three equations defined by Equation 1.

This fourth equation is obtained by defining a value to a linear combination of a first subset of the N drive components D1, . . . , DN and a second subset of the N-drive components D1, . . . , DN. The first subset comprises a first linear combination LC1 of 1≦M1<N of the N drive components D1, . . . , DN, and the second subset comprising a second linear combination LC2 of 1≦M2<N of the N drive components D1, . . . , DN. The first and the second linear combinations are different. Both the first and the second linear combination may comprise only one drive component or several drive components. The solution for the N drive components D1, . . . , DN is found by solving the extended set of equations. Preferably, the drive components which are in the first set are not in the second set and the other way around such that the linear combinations LC1 and LC2 refer to different sub-groups of the sub-pixels which belong to the same pixel.

In this example, the linear combination LC1 is related to a weighted luminance of a first sub-group of sub-pixels of a pixel, and the linear combination LC2 is related to a weighted luminance of a second sub-group of other sub-pixels of the same pixel. The extra equation thus defines a linear combination of weighted luminances which should be equal to the value. The first sub-group of sub-pixels and the second sub-group of sub-pixels may comprise only one sub-pixel, and need not contain together all the sub-pixels of a pixel.

Preferably, the first linear combination LC1 defines the luminance of the drive components of the first subset, and the second linear combination defines the luminance of the drive components of the second subset. Thus, the linear combination LC1 is directly indicative for the luminance produced by the sub-pixels which are associated with the drive components which are a member of the first subset. And, the linear combination LC2 is directly indicative for the luminance produced by the sub-pixels which are associated with the drive components which are member of the second subset. The value defines a constraint to a linear combination of these luminances. For example, this constraint defines that the luminance of the first linear combination should be equal to the luminance of the second linear combination to obtain a minimum amount of artifacts caused by too different luminances of the adjacent sub-pixels SP1 to SPN of the same pixel. For such an equal luminance constraint, the linear combination of the first and second subset is a subtraction, and the value is substantially zero. Such an equal luminance constraint will be elucidated for different embodiments with respect to FIGS. 7 and 8.

But first, in the now following, it is elucidated how the functions defining the three drive signals D1 to D3 as a function of the fourth drive signal D4 are determined.

Equation 1 can be rewritten into:

$$\begin{bmatrix} Cx \\ Cy \\ Cz \end{bmatrix} = [A] \times \begin{bmatrix} D1 \\ D2 \\ D3 \end{bmatrix} + \begin{bmatrix} t14 \\ t24 \\ t34 \end{bmatrix} \times D4 \qquad \text{Equation 2}$$

$$A = \begin{bmatrix} t11 & t12 & t13 \\ t21 & t22 & t23 \\ t31 & t32 & t33 \end{bmatrix}$$

wherein the matrix [A] is defined as the transforming matrix in the standard three primary system. Multiplication of the terms of equation 2 with the inverse matrix $[A^{-1}]$ provides Equation 3.

$$\begin{bmatrix} P1' \\ P2' \\ P3' \end{bmatrix} = \begin{bmatrix} D1 \\ D2 \\ D3 \end{bmatrix} + [A^{-1}] \times \begin{bmatrix} t14 \\ t24 \\ t34 \end{bmatrix} \times D4 \qquad \text{Equation 3}$$

The vector [P1' P2' P3'] represents primary values obtained if the display system only contains three primaries and is defined by the matrix multiplication of the vector [Cx Cy Cz] with the inverse matrix $[A^{-1}]$. Finally, Equation 3 is rewritten into Equation 4.

$$\begin{bmatrix} D1 \\ D2 \\ D3 \end{bmatrix} = \begin{bmatrix} P1' \\ P2' \\ P3' \end{bmatrix} + \begin{bmatrix} k1 \\ k2 \\ k3 \end{bmatrix} \times D4 \qquad \text{Equation 4}$$

Thus, the driving signal of any three primaries D1 to D3 is expressed by Equation 4 as a function of the fourth primary D4. These linear functions F1 to F3 define three lines in a two-dimensional space defined by the fourth primary D4 and the values of the fourth primary D4 as is illustrated in FIG. 7 All values in FIG. 7 are normalized which means that the values of the four drive values D1 to D4 have to be within the range 0≦Di≦1. From FIG. 7 it directly visually becomes clear what the common range VR of D4 is for which all the functions F1 to F3 and the fourth drive signal D4 have values which are in the valid range. It has to be noted that the coefficients k1 to k3 are predefined by the color coordinates of the sub-pixels associated with the drive values D1 to D4.

In the example shown in FIG. 7, the boundary D4 min of the valid range VR is determined by the function F2 which has a higher value than 1 for values of D4 smaller than D4min. The boundary D4max of the valid range VS is determined by the function F3 which has a higher value than 1 for values of D4 larger than D4max. Basically, if no such common range VR exists, then the input color is outside the four primary color gamut and thus cannot be correctly reproduced. For such colors a clipping algorithm should be applied which clips these colors to the gamut. A scheme which calculates the common range D4min to D4max is elucidated in the non pre-published European patent application 05102641.7, which is incorporated herewith by reference. The existence of the common range VR indicates that many possible solutions exist for the conversion from the particular values of the three input components R, G, B to the four drive components D1 to D4. The valid range VR contains all possible values of the drive component D4 which provide a conversion for which the intensity and color of the four sub-pixels is exactly corresponding to that indicated by the three input components R, G, B. The values of the other three drive components D1 to D3 are found by substituting the selected value of the drive component D4 into Equation 4.

FIG. 7 further shows the lines LC1 and LC2. The line LC1 represents the luminance of the drive component D4, the line LC2 represents the luminance of the drive components D1 to D3. Thus, the first subset of the N drive components only comprises the weighted drive component D4 to represent the luminance of the associated sub-pixel. The second subset of the N drive components comprises a weighted linear combination of the three drive components D1 to D3 such that this linear combination represents the luminance of the combination of the sub-pixels associated with these three drive components D1 to D3. At the intersection of these lines LC1 and LC2, which occurs for the drive value D4opt, the luminance of the drive component D4 is equal to the luminance of the combination of the drive components D1 to D3.

This equal luminance constraint is especially interesting for a spectral sequential display 3 which drives one set of the primaries during the even frames and the remaining set of primaries during the odd frames. The algorithm processes a given input color defined by the input components R, G, B under the equal luminance constraint into output components D1 to DN such that the luminance generated by the first subset of sub-pixels during the even frames is equal to the luminance generated by the second subset of the sub-pixels during the odd frames. Thus, the first subset of the N drive components drives the first subset of sub-pixels during the even frames, and the second subset of the N drive components drives the second subset of the sub-pixel during the odd frames, or the other way around. If for a given input color it is impossible to reach an equal luminance during both frames, either the input color is clipped to a value which allows equal luminances, or the output components are clipped to obtain an as equal as possible luminance.

For example, in a RGBY display (R=red, G=green, B=blue, and Y=yellow), only the blue and green sub-pixels are driven in the even frames while only the red and yellow sub-pixels are driven in the odd frames, or the other way around. Of course any other combination of colors is possible also. In this example, in FIG. 2, the two lines LC1 and LC2 should represent the luminance of the blue plus green drive components, and the luminance of the yellow and red drive components, respectively. The value D4opt of the drive component D4 at which these two lines LC1 and LC2 intersect is the optimal value at which the luminance of the blue and green sub-pixels is equal to the luminance of red and yellow sub-pixels. This approach minimizes temporal flicker.

In fact, Equation 1 has been extended by adding a fourth row to the matrix T. The fourth row defines the additional equation $$t21*D1+t22*D2-t23*D3-t24*D4=0$$

The coefficients are t21 to t24 because Cy defines the luminance. The first subset contains the linear combination of the drive values D1 and D2, the second subset contains the linear combination of the drive values D3 and D4, and the value is zero. This additional equation adds an equal luminance constraint to Equation 1. Thus, the solution of the extended equation provides equal luminances for the sub-pixels SP1 and SP2 which are driven by the drive components D1 and D2 on the one hand, and for the sub-pixels SP3 and SP4 which are driven by the drive components D3 and D4 on the other hand. The extended equation is defined by $$\begin{bmatrix} Cx \\ Cy \\ Cz \\ 0 \end{bmatrix} = \begin{bmatrix} t11 & t12 & t13 & t14 \\ t21 & t22 & t23 & t24 \\ t31 & t32 & t33 & t34 \\ t21 & t22 & -t23 & -t24 \end{bmatrix} \times \begin{bmatrix} D1 \\ D2 \\ D3 \\ D4 \end{bmatrix} = [TC] \times \begin{bmatrix} D1 \\ D2 \\ D3 \\ D4 \end{bmatrix} \quad \text{Equation 5}$$

Equation 5 can be easily solved by calculating $$\begin{bmatrix} D1 \\ D2 \\ D3 \\ D4 \end{bmatrix} = \begin{bmatrix} TC11 & TC12 & TC13 & TC14 \\ TC21 & TC22 & TC23 & TC24 \\ TC31 & TC32 & TC33 & TC34 \\ TC41 & TC42 & TC43 & TC44 \end{bmatrix} \times \begin{bmatrix} Cx \\ Cy \\ Cz \\ 0 \end{bmatrix} = [TC^{-1}] \times \begin{bmatrix} Cx \\ Cy \\ Cz \\ 0 \end{bmatrix}$$

wherein $[TC^{-1}]$ is the inverse matrix of [TC].

The solution for the drive components D1 to D4 makes sense if all drive components D1 to D4 have valid values, which if normalized, is true if $0 \leqq Di \leqq 1$ for i=1 to 4. For some input colors defined by the input components R, G, B this will not be achievable. The optimal drive value D4opt of the drive component D4 corresponds to the drive value allowing flicker free operation, and is defined by $$D4\text{opt}=TC41*Cx+TC42*Cy+TC43*Z \quad \text{Equation 6}$$

The coefficients TC41, TC42, TC43 do not depend on the input color. The values of the other drive components D1 to D4 are calculated by using Equation 4. As long as the optimal drive value D4opt occurs within the valid range VR, the solution provides equal luminance in both even and odd sub-frames.

If the optimal value D4opt does not occur within the valid range VR, this value is clipped to the nearest boundary value D4min or D4max, and this clipped value is used to determine the values of the other drive components D1 to D3 with Equation 4. Now, the luminance is not equal in both even and odd sub-frames. However, due by the clipping towards the nearest boundary value, a minimal error occurs. The luminance error is defined by $$\Delta L=(t21*D1+t22*D2)-(t23*D3+t24*D4)$$

which by substitution of Equation 4 therein provides $$\Delta L=(P1'*t21+P2'*t22-P3'*t23)+D4\text{opt}(k1*t21+k2*t22-k3*t23-t24)$$

which is zero if D4opt is not clipped. However, the clipping adds an error to ΔD4 to the optimal value D4opt. The resulting luminance error is $$\Delta L=\Delta D4(k1*t21+k2*t22-k3*t23-t24)$$

It has to be noted that the term k1*t21+k2*t22−k3*t23−t24 is a constant, and thus the luminance error ΔL is determined only by the value of the error ΔD4. Consequently, the minimal error of the drive component D4 causes a minimal error of the luminances of the sub-pixels groups during the different sub-frames.

The method of converting the three input components R, G, B into the four drive components D1 to D4 by adding the fourth equal luminance equation to the three equations which define the relation between the three input components R, G, B and the four drive components D1 to D4 is very efficient for any spectrum sequential display with four primary colors supplied by four sub-pixels SP1 to SP2. There are no limitations with respect to the color points of the primary colors. The algorithm can also directly be used for six-primary systems as a part of the conversion. The algorithm can also be used for any other number of primaries (sub-pixels per pixel) higher than 4. But, usually, this leads to a range of possible solutions if no further constraints are implemented. One advantage of this approach is that large and costly look-up tables are avoided. The conversion is low-cost because per sample only 17 multiplications, 14 additions, two min/max operations have to be performed.

FIG. 8 shows a graph for elucidating another embodiment of the additional equation. FIG. 8 shows an example wherein N=4, the display is an RGBW display, and the fourth equation defines an equal luminance constraint. In this example, in the RGBW display, the drive component D1 drives the red sub-pixel, the drive component D2 drives the green sub-pixel, the drive component D3 drives the blue sub-pixel, and the drive component D4 drives the white sub-pixel. Now, if possible at the particular values of the three input components R, G, B, the luminance of the RGB sub-pixels is kept equal to the luminance of the white pixel to minimize the spatial nonuniformity. Instead of RGBW, other colors may be used, as long as the color of the single sub-pixel can be produced by the combination of the other three sub-pixels.

FIG. 8 shows the three drive components D1 to D3 as a function of the fourth drive component D4. The fourth drive component D4 is depicted along the horizontal axis, and the three drive components D1 to D3 together with the fourth drive component D4 along the vertical axis. The drive components D1 to D4 which are used to drive the sub-pixels of the display 3, are in the now following also referred to as drive signals. The drive signals D1 to D4 of a same drive sample may drive the sub-pixels of a same pixel. Alternatively, the drive components D1 to D4 of adjacent samples may be sub-sampled to sub-pixels of the same pixel. Now, not all drive components D1 to D4 are actually assigned to a sub-pixel.

The three drive signals D1 to D3 are defined as functions of the fourth drive signal D4: F1=D1(D4), F2=D2(D4), and F3=D3 (D4). The fourth drive signal D4 is a straight line through the origin and has a first derivative which is one. In this example, a linear light domain is selected wherein the functions F1 to F3 are straight lines. The valid ranges of the four drive signals D1 to D4 are normalized to the interval 0 to 1. The common range VR of the fourth drive signal D4 in which all the three drive signals D1 to D3 have values within their valid ranges extends from the value D4min to D4max, and includes these border values.

In this embodiment, the line F4 is supposed to also indicate the luminance of the white sub-pixel SP4. The line Y(D4) indicates the combined luminance of the RGB sub-pixels SP1 to SP3 for the particular three input components R, G, B. The luminance indicated by the line Y(D4) is normalized towards the luminance of the white W sub-pixel such that at the intersection of the line Y(D4) which the line D4(D4) the combined luminance of the RGB sub-pixels SP1 to SP3 is equal to the luminance of the W sub-pixel SP4. This intersection occurs at the value D4opt of the drive component D4. Again, the values of the other drive components D1 to D3 are found by substituting D4opt in equation 4.

In a special situation wherein the chromaticity of the W sub-pixel SP4 coincides with the white point of the chromaticity diagram created by the RGB sub-pixels SP1 to SP3, the functions F1 to F3 become even simpler: all the coefficients k1 to k3 of Equation 4 have an equal negative value. Thus the lines representing the functions F1 to F3 intersect the line P4=P4 under the same angle. If further the maximal possible luminance of the W sub-pixel SP4 is equal to the maximal possible luminance of the RGB-sub-pixels SP1 to SP3, then all the coefficients k1 to k3 of Equation 4 have the value −1, and the lines representing the functions F1 to F3 intersect the line P4=P4 under 90 degrees.

This approach which adds a fourth linear equation defining an equal luminance constraint to the three equations which define the relation between the four drive components D1 to D4 and the three input components R, G, B improves the spatial homogeneity between the RGB and W sub-pixels. In fact, Equation 1 has been extended by adding a fourth row to the matrix T. The fourth row defines the additional equation $$t21*D1+t22*D2+t23*D3-t24*D4=0$$

The coefficients are t21 to t24 because Cy defines the luminance in the linear XYZ color space. The first subset contains the linear combination of the drive values D1, D2 and D3 which drive the RGB sub-pixels SP1, SP2, SP3. The second subset contains a linear combination which comprises the drive value D4 only. This additional equation adds an equal luminance constraint to Equation 1. Thus, the solution of the extended equation provides equal luminances for the combined luminance of the sub-pixels SP1, SP2 and SP3 which are driven by the drive components D1, D2 and D3 on the one hand, and for the sub-pixel SP4 which is driven by the drive component D4 on the other hand.

The extended equation is defined by $$\begin{bmatrix} Cx \\ Cy \\ Cz \\ 0 \end{bmatrix} = \begin{bmatrix} t11 & t12 & t13 & t14 \\ t21 & t22 & t23 & t24 \\ t31 & t32 & t33 & t34 \\ t21 & t22 & t23 & -t24 \end{bmatrix} \times \begin{bmatrix} D1 \\ D2 \\ D3 \\ D4 \end{bmatrix} = [TC'] \times \begin{bmatrix} D1 \\ D2 \\ D3 \\ D4 \end{bmatrix} \quad \text{Equation 7}$$

Equation 6 can be easily solved by calculating $$\begin{bmatrix} D1 \\ D2 \\ D3 \\ D4 \end{bmatrix} = \begin{bmatrix} TC11' & TC12' & TC13' & TC14' \\ TC21' & TC22' & TC23' & TC24' \\ TC31' & TC32' & TC33' & TC34' \\ TC41' & TC42' & TC43' & TC44' \end{bmatrix} \times \begin{bmatrix} Cx \\ Cy \\ Cz \\ 0 \end{bmatrix} = [TC'^{-1}] \times \begin{bmatrix} Cx \\ Cy \\ Cz \\ 0 \end{bmatrix}$$

wherein $[TC^{-1}]$ is the inverse matrix of [TC']

The optimal drive value D4opt of the drive component D4 corresponds to the drive value allowing optimal spatial homogeneity, and is thus defined by $$D4opt=TC41'*Cx+TC42'*Cy+TC43'*CZ. \quad \text{Equation 8}$$

It has to be noted that Equation 8 has the same structure as Equation 6, only the matrix coefficient are different.

As discussed for the example with respect to FIG. 2, if the optimal drive value D4opt determined occurs outside the valid range VR, this optimal drive value is clipped to the nearest boundary value D4min or D4max.

FIG. 9 shows a block diagram of an embodiment of an implementation of the conversion in accordance with the invention. The dashed block 5 is identical to the system 1 which converts the three-primary input color signal IS into an N-primary color drive signal DS. However, in FIG. 6 the three-primary input color signal IS is a RGB signal which need not be defined in a linear light domain. In FIG. 9 it is assumed that the three-primary input color signal IS is defined in the linear light domain by the input components Cx, Cy, Cz of the linear XYZ color space. The three-primary input color signal IS may be directly defined in the linear XYZ color space or may first be converted from a non-linear color space, such as the RGB color space, to the linear XYZ color space. The conversion system 5 comprises a calculation unit 51, a clipping unit 52, a calculation unit 53, an interval unit 50, and a storage unit 54. These units may be implemented as hardware or as software modules.

The interval unit 50 receives the input components Cx, Cy, and Cz and determines the border values D4min and D4max of the fourth drive component D4. The interval unit 50 further calculates the values for the vector [P1' P2' P3'] which represents primary values obtained if the display system only contains three primaries. This vector is, as elucidated with respect to Equations 2 and 3, defined by $$\begin{bmatrix} P1' \\ P2' \\ P3' \end{bmatrix} = [A^{-1}] \times \begin{bmatrix} Cx \\ Cy \\ Cz \end{bmatrix}$$

wherein $[A^{-1}]$ is the inverse matrix of the matrix [A] defined in equation 2. Thus, the value of the components P1', P2', P3' of this vector depend on the values of the input components Cx, Cy, Cz.

The storage unit 54 stores both the values B1, B2, B3 and the values of the coefficients k1, k2, k3 of Equation 4. The values B1, B2, B3 depend on the application. In the embodiment discussed with respect to FIG. 2 for a spectral sequential display 3 wherein the temporal flicker is minimized, the optimal drive value D4opt of the drive component D4 is defined by Equation 6. The coefficients TC41, TC42, TC43 do not dependent on the input color and can be pre-stored. Thus, for this embodiment, the values B1, B2, B3 are identical to the coefficients TC41, TC42, TC43, respectively. In the embodiment discussed with respect to FIG. 3 for an RGBW display 3 wherein the spatial homogeneity is optimized, the optimal drive value D4opt of the drive component D4 is defined by Equation 8. Also now, the coefficients TC41', TC42', TC43' do not dependent on the input color and can be pre-stored. Thus, for this embodiment, the values B1, B2, B3 are identical to the coefficients TC41', TC42', TC43', respectively.

The calculation unit 51 receives the input components Cx, Cy, Cz and the values B1, B2, B3 to determine the optimal drive value D4opt of the drive component D4 in accordance with Equation 6 or 8. The clipping unit 52 receives the optimal drive value D4opt and the border values D4min and D4max and supplies the optimal drive value D4opt'. The clipping unit 52 checks whether the optimal drive value D4opt calculated by the calculation unit 51 occurs within the valid range VR with the border values D4min and D4max as determined by the interval unit 50. If the optimal drive value D4opt occurs within the valid range VR, the optimal drive value D4opt' is equal to the optimal drive value D4opt. If the optimal drive value D4opt occurs outside the valid range VR, the optimal drive value D4opt' becomes equal to the border value D4min, or D4max which is closest to the optimal drive value D4opt.

The optimal drive value D4opt' is the output component D4 of the output signal DS of the conversion system 5. The calculation unit 53 calculates the other output components D1 to D3 by substituting the output component D4 into Equation 4.

It has to be noted that the embodiments are elucidated for N=4 for an equal luminance constraint for spectral sequential display 3 and for an RGBW display. However, the scope of the present invention is much wider as is defined by the claims. A same approach is possible for N>4. The addition of at least the linear equation which defines a value for a linear combination of a first subset of the N drive components D1, . . . , DN and a second subset of the N-drive components D1, . . . , DN to obtain an extended set of equations, will narrow the possible solutions to that defined by the constraint imposed by the linear equation. Such a linear equation imposes a weighted luminance constraint to the different sub-sets of drive components D1, . . . , DN. It is possible for N>4 to combine this luminance constraint with another constraint, such as for example a minimum of the maximum value of the drive components D1 to DN.

The algorithm is very attractive for portable or mobile applications which use a spectrum-sequential multi-primary display. However, the algorithm can be used in other spectrum-sequential applications as TV, computer, medical displays in which the advantages of the spectrum-sequential approach are desired, but the main disadvantage, which is the flicker, is avoided. The algorithm may only be used for the specific color components or for specific ranges of the input signal. For example, the algorithm may not include the drive components for sub-pixels which do not or only minimally contribute to flicker. Or, the algorithm is not used for saturated or bright colors.

It has to be noted that it is important in a typical user system which comprises a camera, a printer, and a display, that the correct color is printed and displayed. Therefore, the image information exchanged between the camera and the printer or display device should be in a universal format. This universal format is preferably the XYZ color space. The devices which are receiving the image from the camera have a color management module which converts the image in the XYZ color space to the color space required by the device. In a printer, this color management module converts the image in the XYZ space usually to a CMY color space. In a display, the color management module converts the image in the XYZ space usually to a RGB color space. However, in a display in accordance with the invention, the color management module in the display converts the image in the XYZ space to the color space defined by the four primary colors of the four sub-pixels. This conversion may be performed directly or via the RGB color space.

Further, it should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

In practice, the algorithmic components disclosed in this text may be, entirely or in part, realized as hardware, or as software running on a special digital signal processor or a generic processor, etc. The hardware may be a part of an application specific IC.

Under computer program product should be understood any physical realization of a collection of commands enabling a generic or special purpose processor to execute any of the characteristic functions of an invention. The commands may be loaded in one step or in a series of loading steps into the processor. The series of loading steps may include intermediate conversion steps, such as for example, a translation into an intermediate language, and/or into a final processor language. In particular, the computer program product may be realized as data on a carrier such as, for example, a disk or tape, a memory, data traveling over a wired or wireless network connection, or program code on any other medium such, as for example, paper. Apart from program code, characteristic data required for the program may also be embodied as a computer program product. Some of the steps required for the operation of the method, such as, for example, data input and output steps, may be already present in the functionality of the processor instead of being defined in the computer program product.

The invention claimed is:

1. A method of mapping a four-primary input signal (IS) to sets (Pij) of four sub-pixels (RPij, GPij, BPij, WPij) of a display device (DD), wherein the four-primary input signal (IS) comprises a sequence of input samples (Sij) each comprising a value for a first component (Rlij), a value for a second component (Glij), a value for a third component (Blij), and a value for a fourth component (Wlij), and wherein the sets (Pij) of the four sub-pixels comprise a first sub-pixel (RPij) for supplying light having a first primary color (R), a second sub-pixel (GPij) for supplying light having a second primary color (G), a third sub-pixel (BPij) for supplying light having a third primary color, and a fourth sub-pixel (WPij) for supplying fourth light having a fourth color (W), the first, second, third and fourth color all being different, and the fourth color being within the color gamut of the first, second, and third color, the method comprising sub-sampling (MAP) the input samples (Sij) of the four primary input signal (IS) (i) by assigning, via mapping, a first component (RI11), a second component (GI11), and a third component (BI11) of a particular input sample (S11) to the first (RP11), second (GP11) and third sub-pixel (BP11) of a particular set (P11) of four adjacent sub-pixels, respectively, and (ii) by assigning, via, mapping, a fourth component (WI12) of a further input sample (S12) to the fourth sub-pixel (WP11) of said same particular set (P11) of the four adjacent sub-pixels, wherein the particular input sample (S11) and the further input sample (S12) are associated with adjacent positions on the display device (DD), and wherein the further input sample (S12) is adjacent to, separate and distinct from, the particular input sample (S11) in the input samples (Sij) of the four primary input signal (IS).

2. A method as claimed in claim 1, wherein the first primary color (R) is red, the second primary color (G) is green, and the third primary color (B) is blue.

3. A method as claimed in claim 2, wherein the display device (DD) is illuminated by a backlight unit (BL), and wherein a red filter (RF) is associated with the first sub-pixel (RPij), a green filter (GF) is associated with the second sub-pixel (GPij), and a blue filter (BF) is associated with the third sub-pixel (BPij), and wherein light (BLL) generated by the backlight unit (BL) passes the fourth sub-pixel (WPij) unfiltered.

4. A method as claimed in claim 1, wherein the fourth color (W) is white.

5. A method as claimed in claim 1, wherein, in the four-primary input signal (IS), the further input sample (S12) is located relative to the particular input sample (S11) to correspond to a position of the fourth sub-pixel (WPij) relative to the sub-group of the first, second and third sub-pixels (RPij, GPij and BPij) in the set (Pij), respectively.

6. A method as claimed in claim 5, wherein the further input sample (S12) immediately succeeds or precedes the particular input sample (S11) in a particular line of a video input image, and wherein the method further comprising:

sub-sampling a third input sample (S21) and a fourth input sample (S22) to a further set of sub-pixels, the further set of sub-pixels comprises a fifth sub-pixel (RP21) for supplying light having the first color (R), a sixth sub-pixel (GP21) for supplying light having the second color (G), a seventh sub-pixel (BP21) for supplying light having the third color (B), and an eighth sub-pixel (WP21) for supplying light having the fourth color (W), the sub-sampling further comprises (iii) assigning, via mapping, a first component (RI22), a second component (GI22), and a third component (BI22) of the fourth input sample (S22) to the fifth (RP21), sixth (GP21) and seventh (BP21) sub-pixel of a second particular set (P21) of four adjacent sub-pixels, respectively, and (iv) assigning, via mapping, a fourth component (WI21) of the third input sample (S21) to the eighth sub-pixel (WP21) of said same second particular set (P21) of the four adjacent sub-pixels, wherein, in the four-primary input signal (IS), the fourth input sample (S22) is located relative to the third input sample (S21) to correspond to a position of the eighth sub-pixel (WP21) relative to the sub-group of the fifth, sixth, and seventh sub-pixels (RP21, GP21 and BP21) in the second set (P21) of four adjacent sub-pixels, respectively, wherein the fourth input sample (S22) immediately succeeds or precedes the third input sample (S21) in a further particular line of a video input image, and the further particular line immediately succeeds or precedes the particular line, wherein the particular line and the further particular line may extend horizontally or vertically.

7. A method of driving a display device (DD) having sets (Pij) of four sub-pixels (RPij, GPij, BPij, WPij), the method comprising:

converting, via a multi-primary conversion (MPC), a three primary color input signal (TIS) into the four primary input signal (IS), under an equal luminance constraint for (i) on the one hand a luminance of the combination of the first component (Rlij), the second component (Glij), and the third component (Blij), and (ii) on the other hand a luminance of the fourth component (Wlij), and mapping (MAP) the four-primary input signal (IS) to the sets (Pij) of the four sub-pixels (RPij, GPij, BPij, WPij) as claimed in claim 1.

8. A computer program product comprising a processor readable code to enable a processor to execute the method of claim 1, the processor readable code comprising code for sub-sampling the input samples (Sij) of the four primary input signal (IS) by assigning the first component (RI11), the second component (GI11), and the third component (BI11) of a particular input sample (S11) to the first (RP11), second (GP11) and third sub-pixel (BP11) of a particular set (P11) of four adjacent sub-pixels, respectively, and by assigning the fourth component (WI12) of a further input sample (S12) to the fourth sub-pixel (WP11) of said same particular set (P11) of the four adjacent sub-pixels, wherein the particular input sample (S11) and the further input sample (S12) are associated with adjacent positions on the display device (DD).

9. A computer program product as claimed in claim 8, wherein the computer program product is a software plug-in in an image processing application.

10. A system for mapping a four primary input signal (IS) to sets (Pij) of four sub-pixels (RPij, GPij, BPij, WPij) of a display device (DD), wherein the four primary input signal (IS) comprises a sequence of input samples (Sij) each comprising a value for a first component (Rlij), a value for a second component (Glij), a value for a third component (Blij), and a value for a fourth component (Wlij), and wherein the sets (Pij) of the four sub-pixels comprise a first sub-pixel (RPij) for supplying light having a first primary color (R), a second sub-pixel (GPij) for supplying light having a second primary color (G), a third sub-pixel (BPij) for supplying light having a third primary color, and a fourth sub-pixel (WPij) for supplying fourth light having a fourth color (W), the first, second, third and fourth color all being different, and the fourth color being within the color gamut of the first, second, and third color, the system comprising a mapper (MAP) for sub-sampling the input samples (Sij) of the four primary input signal (DS) (i) by assigning, via the mapper, the first component (RI11), the second component (GI11), and the third component (BI11) of a particular input sample (S11) to the first (RP11), second (GP11) and third sub-pixel (BP1) of a particular set (P11) of four adjacent sub-pixels, respectively, and (ii) by assigning, via the mapper, the fourth component (WI12) of a further input sample (S12) to the fourth sub-pixel (WP11) of said same particular set (P11) of the four adjacent sub-pixels, wherein the particular input sample (S11) and the further input sample (S12) are associated with adjacent positions on the display device (DD), and wherein the further input sample (S12) is adjacent to, separate and distinct from, the particular input sample (S11) in the input samples (Sij) of the four primary input signal (IS).

11. A circuit for driving a display device (DD) having sets (Pij) of four sub-pixels (RPij, GPij, BPij, WPij), and comprising:

a multi-primary converter (MPC) for converting a three primary color input signal (TIS) into the four primary input signal (IS), under an equal luminance constraint for (i) on the one hand a luminance of the combination of the first component (Rlij), the second component (Glij), and the third component (Blij), and (ii) on the other hand a luminance of the fourth component (Wlij), and the system as claimed in claim 10.

12. A display apparatus comprising the circuit of claim 11, and a display device having the sets (Pij) of the four sub-pixels (RPij, GPij, BPij, WPij).

13. A portable device comprising the circuit of claim 11, and a display device having the sets (Pij) of the four sub-pixels (RPij, GPij, BPij, WPij).

14. A broadcast system comprising a distribution station (BR) for supplying information (INF) to displays of users (Ui), the distribution station (BR) comprises the system of claim 10, the information (INF) comprising for a particular set (Pij) of four sub-pixels (RPij, GPij, BPij, WPij) of the displays of the users (U1) a the first, second, third, (RI11, GI11, BI11) component of the particular input sample (S11), and the fourth component (WI12) of the further input sample (S12).

15. A method of broadcasting comprising supplying (BR) information (INF) to displays of users (Ui), the supplying (BR) comprising performing the method of claim 1, the information (INF) comprising for a particular set (Pij) of four sub-pixels (RPij, GPij, BPij, WPij) of the displays of the users (Ui) a the first, second, third, (RI11, GI11, BI11) component of the particular input sample (S11), and the fourth component (WI12) of the further input sample (S12).

* * * * *